US006789296B2

(12) United States Patent
Yang

(10) Patent No.: US 6,789,296 B2
(45) Date of Patent: Sep. 14, 2004

(54) BUCKLE ASSEMBLY

(76) Inventor: Long-Shing Yang, No. 10, Alley 35, Lane 193, Chung-Cheng N. Road, San-Chung City (TW)

( * ) Notice: Subject to any disclaimer, the term of this patent is extended or adjusted under 35 U.S.C. 154(b) by 0 days.

(21) Appl. No.: 10/457,370

(22) Filed: Jun. 10, 2003

(65) Prior Publication Data

US 2004/0031129 A1 Feb. 19, 2004

(30) Foreign Application Priority Data

Aug. 16, 2002 (TW) ..... 91118568 A

(51) Int. Cl.[7] ..... A44B 11/12
(52) U.S. Cl. ..... 24/170; 24/191
(58) Field of Search ..... 24/170, 168, 164, 24/163 R, 191, 265 BC, 265 EC

(56) References Cited

U.S. PATENT DOCUMENTS 754,731 A * 3/1904 Addington ..... 24/170
1,059,106 A * 4/1913 Bartlett ..... 24/170
4,727,628 A * 3/1988 Rudholm ..... 24/170
5,291,638 A * 3/1994 Huang ..... 24/170
6,691,377 B2 * 2/2004 Pan ..... 24/170
2003/0172499 A1 * 9/2003 Uehara et al. ..... 24/170

* cited by examiner

*Primary Examiner*—Robert J. Sandy
(74) *Attorney, Agent, or Firm*—Rabin & Berdo, P.C.

(57) ABSTRACT

A buckle assembly includes a fixing seat adapted to securely connected an object and having a hoop, a controlling bracket having a roller rotatably mounted therein, a fixing rod securely sandwiched between two side walls and adjacent to the baffle to correspond to the hoop and a pressing plate pivotally received in the controlling bracket. A spring is provided to provide a recovery force to the pressing plate. The second end of a secondary strap is extended through the adjusting ring to enclose the second roller such that when the adjusting ring is pulled, the pressing plate is detached from engagement with the roller to allow the secondary strap to slide on the roller to adjust a distance of the controlling bracket to the second end of the secondary strap.

4 Claims, 5 Drawing Sheets

BUCKLE ASSEMBLY

BACKGROUND OF THE INVENTION

1. Field of the Invention

The present invention relates to a buckle assembly, and more particularly to a buckle assembly for a variety of different objects such as a backpack or the like. The buckle assembly enables the user to adjust the length of the shoulder strap easily by pulling one end of a secondary strap securely connected to the shoulder strap and extended through the buckle.

2. Description of Related Art

Various buckles are introduced to the market for different products such as backpacks and bras. Usually, there is a strap going through the buckle and fixed to a hanger or the like. When adjustment of the length of the strap is required to meet different users' conditions, the user will have to loose the engagement of the strap to the buckle by pulling the strap for extra length. Then the user pulls the strap from the fixed end to shorten the strap length or the user pulls the strap from the opposite end to lengthen the length of the strap. Thereafter, the length of the strap is adjusted.

However, when the buckle is attached to such as a backpack and there is a load in the backpack, adjustment of the length of the strap seems difficult. The user has to place the backpack on a surface to remove the load on the buckle so as to proceed the strap length adjustment or the user has assistance from the others to lift or support the backpack load so that the load on the backpack is released and then the user is able to proceed the length adjustment. Either placing the backpack on the surface or getting help from the others to release the load on the buckle is quite troublesome. Furthermore, the adjustment of the strap length requires two steps, one is to loose the engagement between the buckle and the strap and the other will be the pulling of the strap from either end of the strap to shorten/lengthen the strap length. This two-step adjustment work is especially difficult for the user taking a hiking. Not only the adjustment will slow down the progress, but also the adjustment will require extra effort to complete.

To overcome the shortcomings, the present invention intends to provide an improved buckle assembly to mitigate the aforementioned problems.

SUMMARY OF THE INVENTION

A primary objective of the invention is to provide an improved buckle assembly with which the user is able to easily adjust the strap length easily.

Another objective of the invention is to provide an adjusting ring having the secondary strap slidably extended therethrough so that the user is able to pull the adjusting ring upward or downward relative to the buckle to easily adjust the strap length.

Other objects, advantages and novel features of the invention will become more apparent from the following detailed description when taken in conjunction with the accompanying drawings.

DETAILED DESCRIPTION OF THE PREFERRED EMBODIMENT

Figure 1:
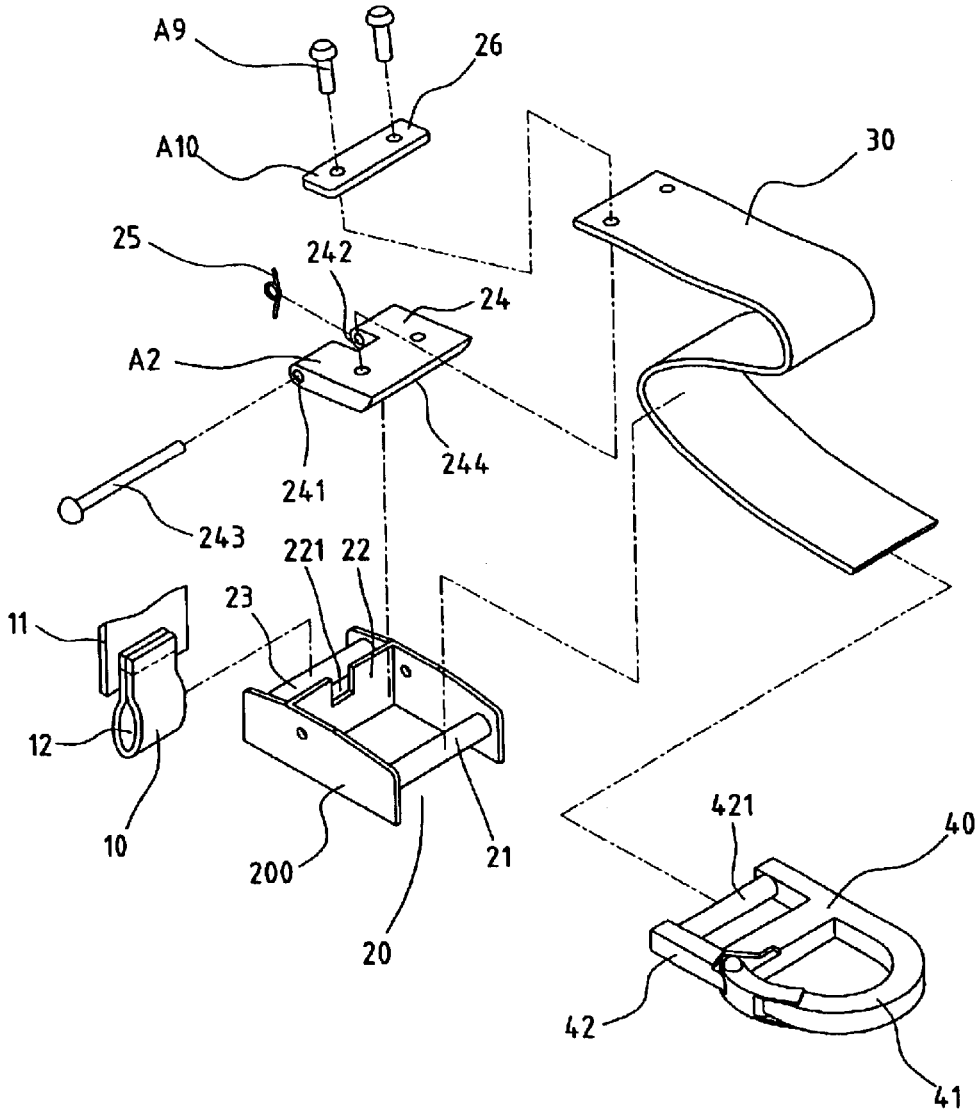
FIG. 1 is an exploded perspective view of the buckle assembly of the present invention.

With reference to FIG. 1, the buckle assembly in accordance with the present invention includes a fixing seat 10, a controlling bracket 20, a secondary strap 30 and an adjusting ring 40.

The fixing seat 10 includes a seat 11 adapted to securely connect to a shoulder strap (not shown) and a hoop 12 securely extended out of the seat 11.

The controlling bracket 20 includes a roller 21 rotatably mounted between two side walls 200, a baffle 22 securely rested between the two side walls 200 and having a cutout 221 defined in a free distal side of the baffle 22, a fixing rod 23 securely sandwiched between the two side walls 200 and adjacent to the baffle 22 to correspond to the hoop 12 of the fixing seat 10. Furthermore, a pressing plate 24 having a pin hole 241 laterally defined in the pressing plate 24 to correspond to a pin 243 and a notch 242 defined in a side of the pressing plate 24 to communicate with the pin hole 241 is received in the controlling bracket 20. A spring 25 is received in the notch 242 and has one end abutted to the fixing rod 23, the other end abutted to a fixing plate 26 which is firmly mounted on top of the pressing plate 24 with one end of the secondary strap 30 securely received therebetween via at least one (two are shown in the preferred embodiment) rivet (not numbered). The other end of the secondary strap 30 extends through the controlling bracket 20.

The adjusting ring 40 includes a pulling ring 41 and a sliding portion 42 with a second roller 421 rotatably mounted in the sliding portion 421.

When the buckle assembly of the present invention is in assembly, the fixing seat 10 is securely connected to a shoulder strap (not shown) with the hoop 12 extended out of the seat 11. The pressing plate 24 is received in the controlling bracket 20 and the pin 243 is extended through the pin hole 241 of the pressing plate 24 to slidably receive the pressing plate 24 in the controlling bracket 20 after the spring 25 is mounted on the pin 243 and received in the cutout 221.

One distal end of the secondary strap 30 is then placed on top of the pressing plate 24 and the fixing plate 26 is applied to secure the connection of the distal end of the secondary strap 30 to the pressing plate 24. Thereafter, the distal end of the secondary strap 30 is extended through the sliding portion 42 with the second roller 421 engaged with the secondary strap 30. Then the distal end of the secondary strap 30 is extended through a gap between the pressing plate 24 and the roller 21. In the mean time, the other distal end of the spring 25 is abutted to a side face of the pressing plate 24. Therefore, with one distal end of the spring 25 abutted on the fixing rod 23 and the other distal end abutted on the side face of the pressing plate 24, the spring 25 is able to provide a recovery force to the pressing plate 24. It is notable that the pressing plate 24 has an inclined face 244 corresponding to the roller 21 so that the secondary strap 30 can be clamped between the inclined face 244 and the roller 21.

Figure 2:
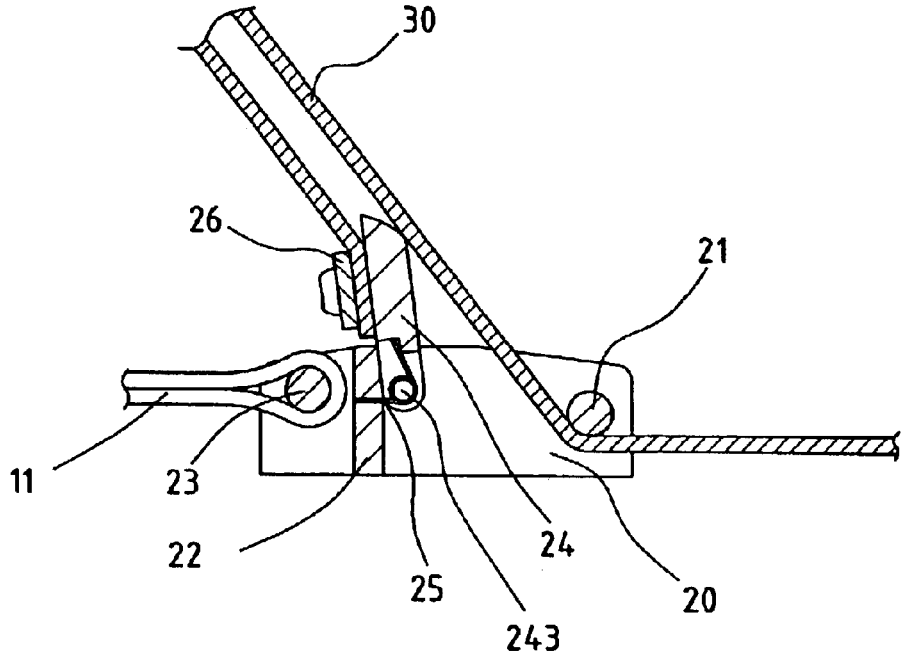
FIG. 2 is a schematic cross sectional view showing that the pressing plate is detached from engagement with the roller.
Figure 3:
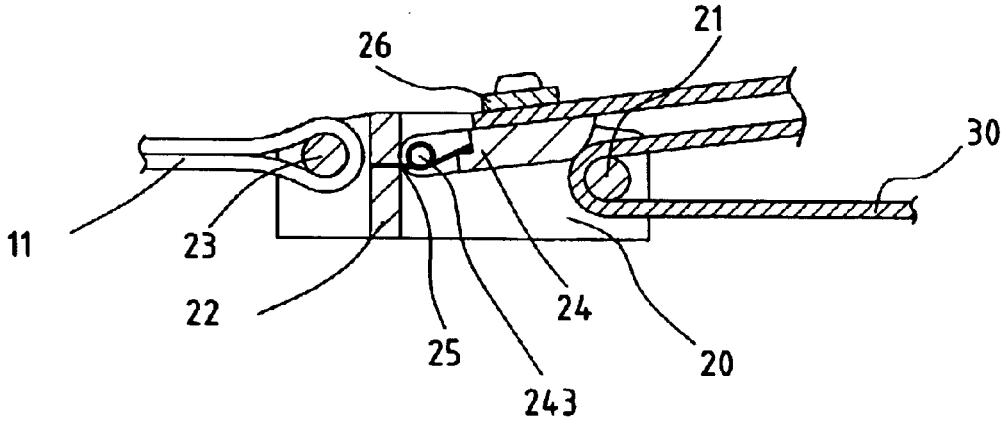
FIG. 3 is a schematic cross sectional view showing that the pressing plate is connected to the roller to sandwich the secondary strap therebetween.
Figures 4A, 4B, 4C:
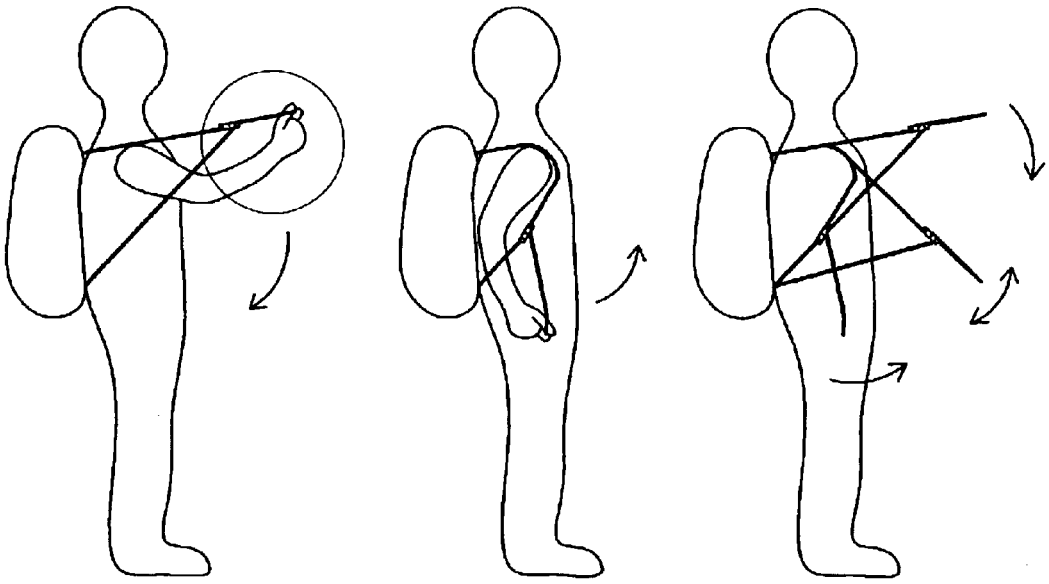
FIG. 4A is a schematic view showing that the adjusting ring is pulled upward to lengthen the shoulder strap length.
FIG. 4B is a schematic view showing that the adjusting ring is pulled downward to shorten the shoulder strap length.
FIG. 4C is a schematic view showing that the user is able to pull the adjusting ring upward or downward to adjust the shoulder strap length.
Figure 4:
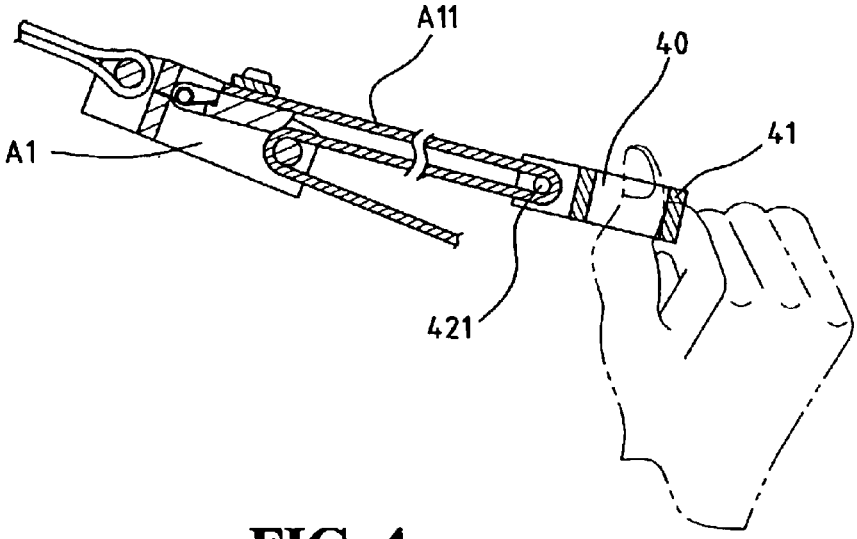
FIG. 4 is a schematic view showing the adjusting ring is pulled when adjustment of the shoulder strap length is required.
Figure 5:
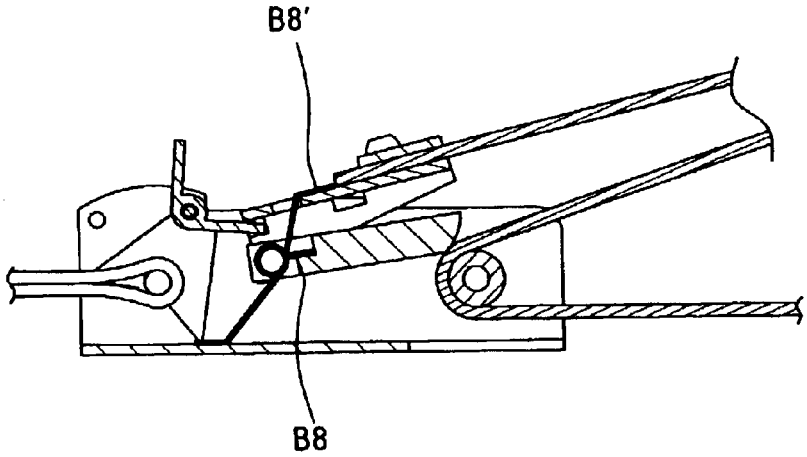
FIG. 5 is a schematic view showing that when the pressing plate is closed to connect to the roller with the secondary strap received therebetween.

With reference to FIGS. 2 and 3, it is noted that when the pressing plate 24 is pulled upward, the gap between the pressing plate 24 and the roller 21 is enlarged such that the secondary strap 30 is able to move freely. That is, the user is able to adjust the secondary strap 30 freely. However, when the pressing plate 24 is closed to sandwich the secondary strap 30 with the roller 21, the adjustment of the secondary strap 30 is impossible.

With reference to FIGS. 4, 4A, 4B and 4C, as described earlier, the other distal end of the secondary strap 30 is extended through the sliding portion 42 and the second roller 421 is enclosed by the secondary strap 30 such that when the user pulls the pulling ring 41 upward or downward, the shoulder strap length is adjusted. It is noted that when the buckle assembly of the present invention is not in use, because the first distal end of the secondary strap 30 is securely connected to the pressing plate 24 via the fixing plate 26 and the other distal end of the secondary strap 30 is then connected to a rear side face of the backpack, therefore, the inclined face 244 of the pressing plate 24 is always in contact with a side face of the secondary strap 30 so that the secondary strap 30 is securely sandwiched between the inclined face 244 and the roller 21. Then, whenever the pulling ring 41 is pulled, the pressing plate 24 is always pulled upward to slightly detach from engagement with the side face of the secondary strap 30 to allow the user to adjust the length of the secondary strap 30, either to lengthen the shoulder strap strength or to shorten the shoulder strap length. Thus, the user is able to easily adjust the shoulder strap length when there is a load in the backpack.

Figure 6:
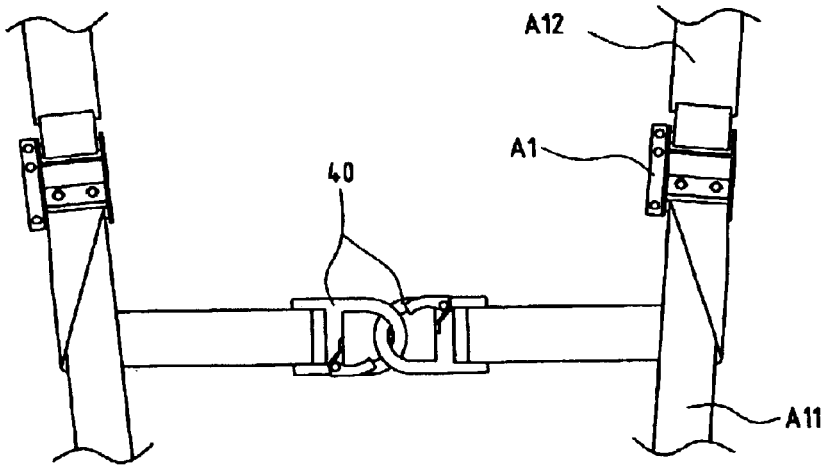
FIG. 6 is a schematic view showing the application of the buckle assembly of the present invention.

With reference to FIG. 6, normally there are two shoulder straps in a backpack such that after the adjustment of the length of the shoulder straps, the two adjusting rings 40 may be connected to each other by a well known method known in the art.

In summary, because the hoop 12 is securely connected to the fixing rod 23 and the secondary strap 30 is extended through the roller 21, when there is a load on the shoulder strap which is connected to the seat 11 of the fixing seat 10, the inclined face 244 of the pressing plate 24 is always in contact with the side face of the secondary strap 30 to securely sandwich the secondary strap 30 with the roller 21. However, when the user pulls the pulling ring 41, either upward to lengthen the shoulder strap length or downward to shorten the shoulder strap length, the pressing plate 24 is slightly detached from the roller 21 to allow the secondary strap 30 to slide on the roller 21. Thus, the adjustment of the shoulder strap length is achieved.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A buckle assembly comprising:

a fixing seat adapted to securely connected an object and having a hoop;

a controlling bracket having a roller rotatably mounted between two side walls of the controlling bracket, a baffle securely formed between the two side walls and having a cutout defined in a free distal side of the baffle, a fixing rod securely sandwiched between the two side walls and adjacent to the baffle to correspond to the hoop of the fixing seat and a pressing plate pivotally received in the controlling bracket;

a spring having a first end abutted to the fixing rod and a second end abutted to a fixing plate which is firmly mounted on top of the pressing plate;

a secondary strap having a first end securely connected to the pressing plate and a second end extending through the controlling bracket to enclose the roller therein; and an adjusting ring having a second roller rotatably mounted in the adjusting ring, wherein the second end of the secondary strap is extended through the adjusting ring and has the second roller enclosed in the secondary strap such that when the adjusting ring is pulled, the pressing plate is detached from engagement with the roller of the controlling bracket to allow the secondary strap to slide on the roller of the controlling bracket to adjust a distance of the controlling bracket to the second end of the secondary strap.

2. The buckle assembly as claimed in claim 1, wherein the adjusting ring includes a pulling ring and a sliding portion with the second roller rotatably mounted in the sliding portion.

3. The buckle assembly as claimed in claim 1, wherein the pressing plate has a pin hole laterally defined in the pressing plate to correspond to a pin and a notch defined in a side of the pressing plate to communicate with the pin hole such that the spring is able to be received in the notch and the pressing plate is able to pivot relative to the controlling bracket.

4. The buckle assembly as claimed in claim 2, wherein the pressing plate has a pin hole laterally defined in the pressing plate to correspond to a pin and a notch defined in a side of the pressing plate to communicate with the pin hole such that the spring is able to be received in the notch and the pressing plate is able to pivot relative to the controlling bracket.

* * * * *